US007766699B1

(12) United States Patent
Lin

(10) Patent No.: US 7,766,699 B1
(45) Date of Patent: Aug. 3, 2010

(54) AUDIO ADAPTER WITH A SLIDEABLE PLUG BODY

(75) Inventor: Chu-Keng Lin, Taipei (TW)

(73) Assignee: Cheng Uei Precision Industry Co., Ltd., Taipei (TW)

( * ) Notice: Subject to any disclaimer, the term of this patent is extended or adjusted under 35 U.S.C. 154(b) by 0 days.

(21) Appl. No.: 12/538,865

(22) Filed: Aug. 11, 2009

(51) Int. Cl.
*H01R 25/00* (2006.01)

(52) U.S. Cl. ..... 439/638

(58) Field of Classification Search ..... 439/638, 439/640, 645, 668; 381/189, 74
See application file for complete search history.

(56) References Cited

U.S. PATENT DOCUMENTS 6,350,150 B2 * 2/2002 DeLadurantaye, III ..... 439/502
6,626,704 B1 * 9/2003 Pikel ..... 439/638
7,056,127 B2 * 6/2006 Suzuki et al. ..... 439/39
7,241,188 B2 * 7/2007 Lin et al. ..... 439/838

* cited by examiner

*Primary Examiner*—Chandrika Prasad

(57) ABSTRACT

An audio adapter includes a base body, a plug module and a receptacle disposed in the base body. The base body defines a receiving cavity at an upper portion thereof and a holding chamber at a lower portion thereof. A portion of the receiving cavity extends upward to penetrate through the base body to form a guiding channel. The plug module includes a plug body received in the receiving cavity and an audio plug. The audio plug has a connecting portion embedded in the plug body and an inserting portion projected out of the plug body. The plug body is provided with a guiding portion thereon. The guiding portion is slidably disposed in the guiding channel. The guiding portion can be pushed along the guiding channel to drive the plug body to slide in the receiving cavity and further drive the inserting portion to be stowed into the receiving cavity.

5 Claims, 6 Drawing Sheets

AUDIO ADAPTER WITH A SLIDEABLE PLUG BODY

BACKGROUND OF THE INVENTION

1. Field of the Invention

The present invention generally relates to an adapter, and more particularly to an audio adapter.

2. The Related Art

A conventional audio adapter includes a base body, a plug module and a receptacle disposed in the base body. One end of the plug module is fastened in the base body and the other end thereof is always exposed out of the base body for being mated with a corresponding external receptacle. The receptacle is mated with a corresponding external plug module. A wire is used for connecting the plug module with the receptacle to form an electrical connection therebetween, and further form an electrical connection between the external receptacle and the external plug module.

However, because the plug module is always exposed out of the base body, it is inconvenient to keep and carry the audio adapter, and furthermore, the plug module is easy to be damaged.

SUMMARY OF THE INVENTION

An object of the present invention is to provide an audio adapter. The audio adapter includes a base body, a plug module and a receptacle disposed in the base body. The base body defines a receiving cavity having one end opened freely at an upper portion thereof and a holding chamber at a lower portion thereof. A portion of the receiving cavity extends upward to penetrate through the base body to form a guiding channel extending along the same direction with the receiving cavity. The receptacle is held in the holding chamber. The plug module includes a plug body movably received in the receiving cavity and an audio plug. The audio plug has a connecting portion embedded in the plug body for being electrically connected with the receptacle and an inserting portion projected out of the plug body. The plug body is provided with a guiding portion thereon. The guiding portion is slidably disposed and restrained in the guiding channel and partially exposed out of the guiding channel. The guiding portion can be pushed along the guiding channel to drive the plug body to slide in the receiving cavity and further drive the inserting portion to be stowed into the receiving cavity.

As described above, the audio adapter can make the audio plug of the plug module projected out of the base body to be used by means of pushing the guiding portion forward and put in the receiving cavity of the base body to be kept by means of pushing the guiding portion rearward so that facilitates the audio adapter to be kept and carried and further prevents the audio plug from being damaged when the audio adapter is not in use.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
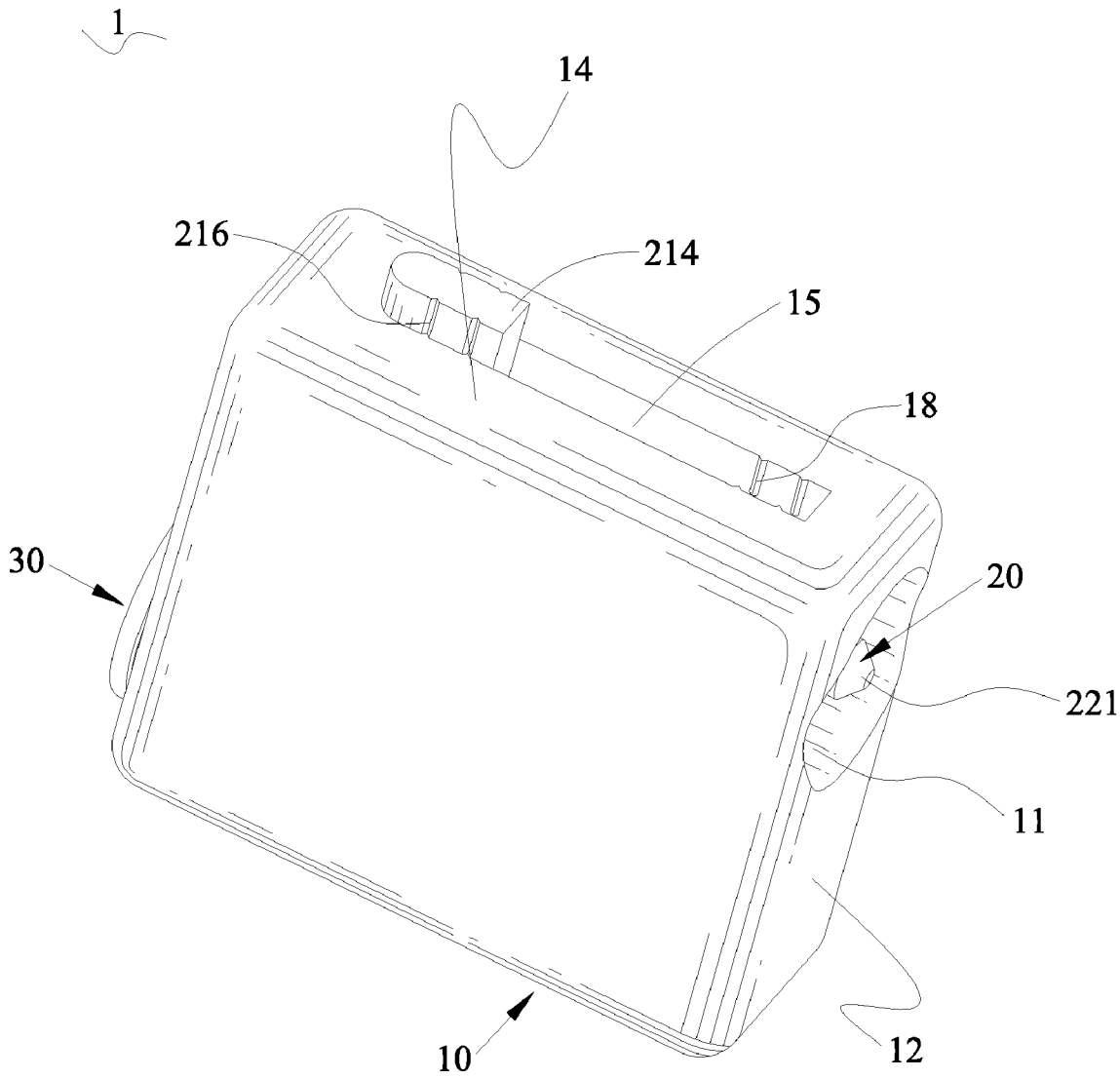
FIG. 1 is a perspective view of an audio adapter in accordance with the present invention, when the audio adapter is not in use.
Figure 2:
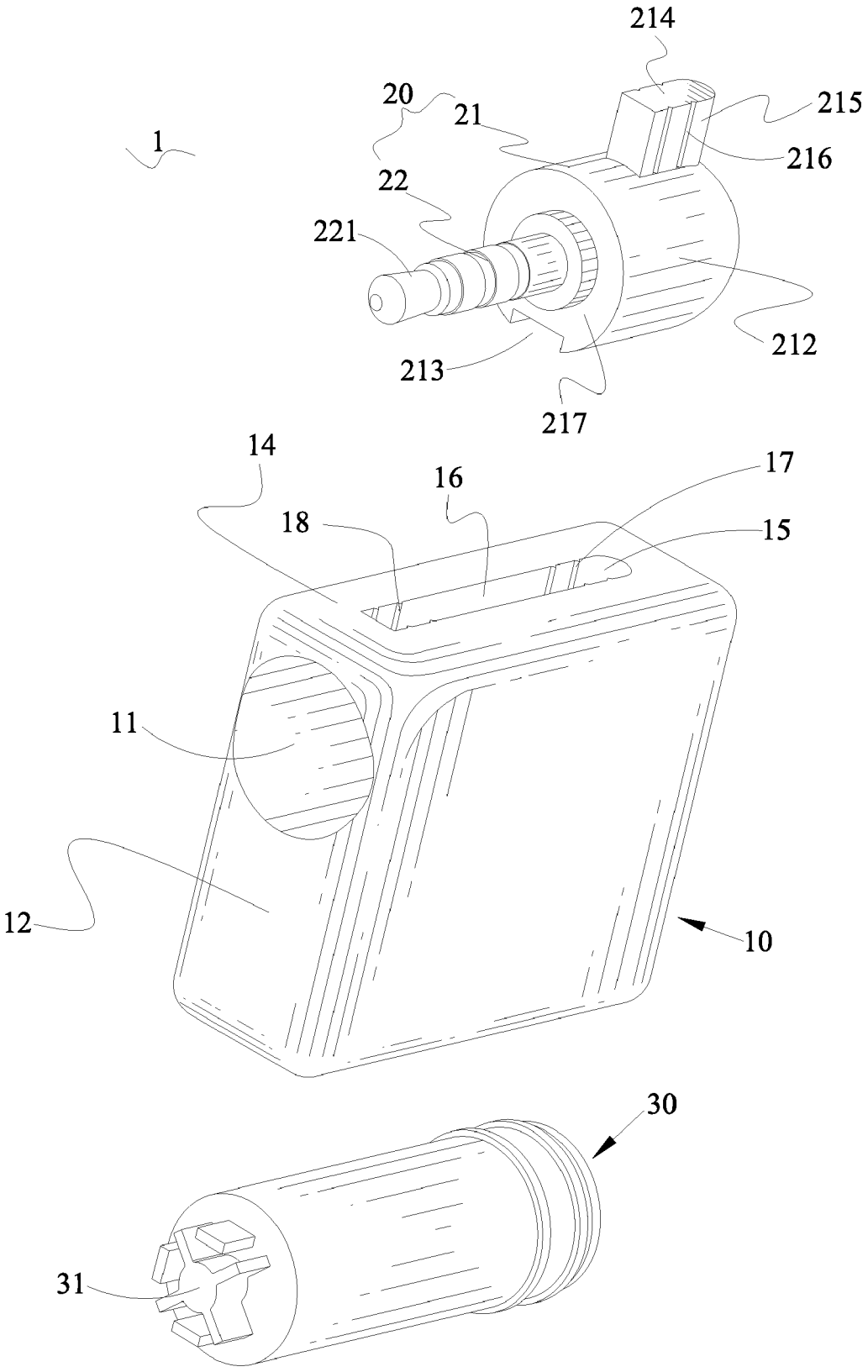
FIG. 2 is an exploded view of the audio adapter of FIG. 1.

With reference to FIG. 1 and FIG. 2, an audio adapter 1 according to the present invention includes a base body 10, a plug module 20 and a receptacle 30 disposed in the base body 10 respectively.

Figure 3:
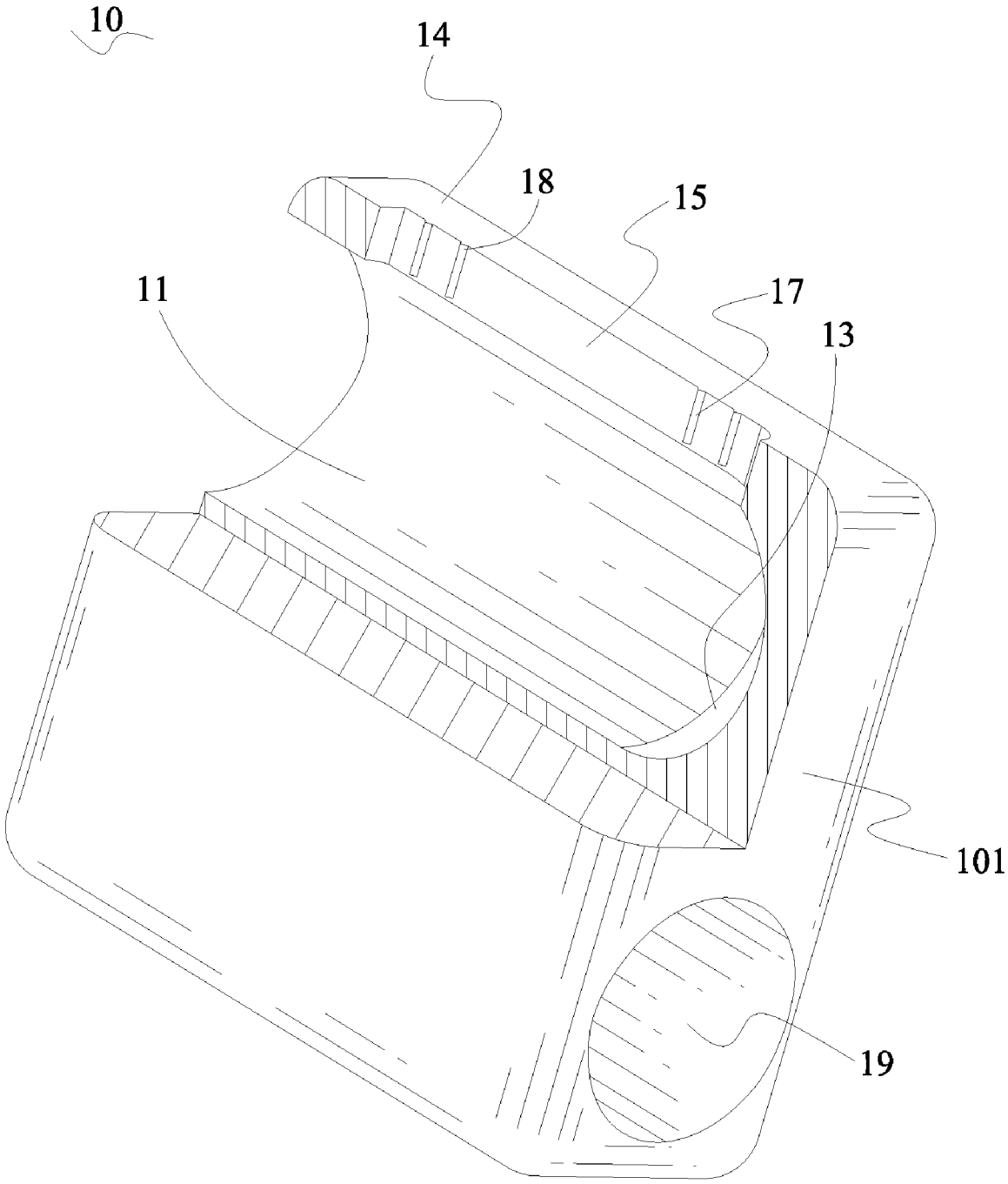
FIG. 3 is a partial cross-sectional view of a base body of the audio adapter of FIG. 1.

Referring to FIG. 2 and FIG. 3, the base body 10 is of rectangular shape, which is vertically disposed and extends longitudinally. An upper portion of the base body 10 defines a cylindrical receiving cavity 11 extending longitudinally to penetrate through a front surface 12 thereof. A substantially hemispherical concave surface 13 is formed on a rear wall of the receiving cavity 11. A middle of the receiving cavity 11 further extends upward to penetrate through a top surface 14 of the base body 10 to form a guiding channel 15 of substantially rectangular shape extending longitudinally and having an arc-shaped rear end. Each of two opposite side surfaces 16 of the guiding channel 15 defines a pair of first locking ribs 17 at a rear thereof spaced from each other and each extending vertically, and a pair of second locking ribs 18 at a front thereof spaced from each other and each extending vertically. A lower portion of the base body 10 defines a cylindrical holding chamber 19 extending longitudinally to penetrate through a rear surface 101 thereof.

Figure 4:
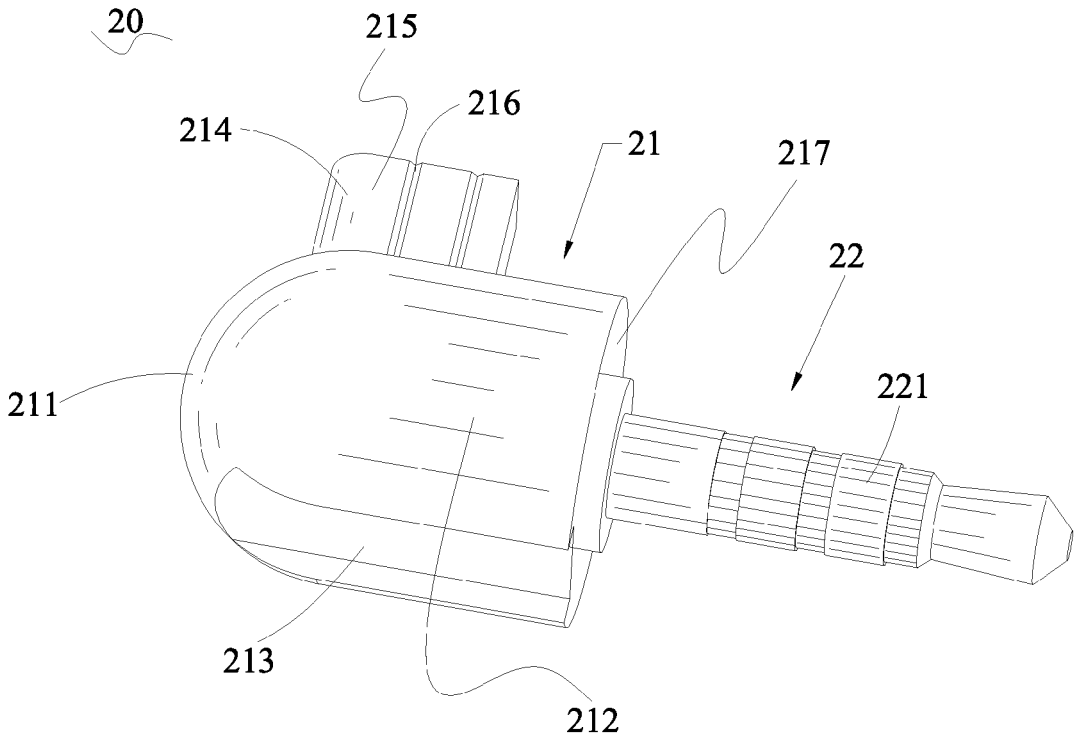
FIG. 4 is a perspective view of a plug module of the audio adapter of FIG. 1.
Figure 5:
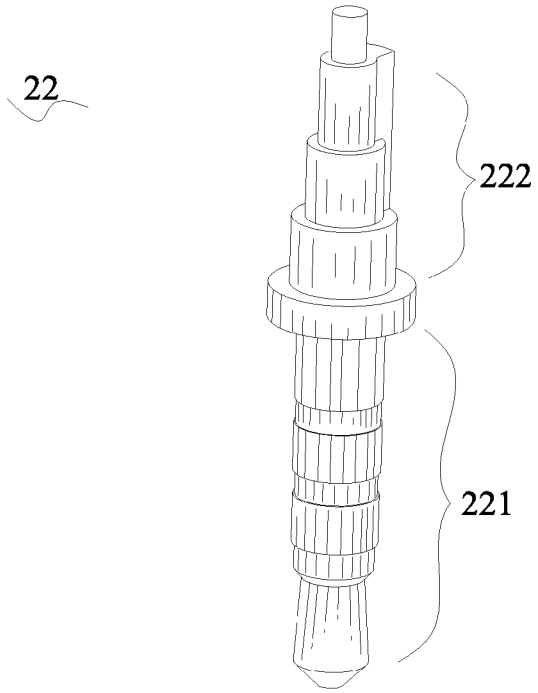
FIG. 5 is a perspective view of an audio plug of the plug module of FIG. 4.

Referring to FIG. 2, FIG. 4 and FIG. 5, the plug module 20 includes a plug body 21 and an audio plug 22. The plug body 21 is of substantially cylindrical shape. A rear end of the plug body 21 is provided with a mating surface 211 with a hemispherical shape. An outer peripheral surface 212 of the plug body 21 defines a receiving fillister 213 extending longitudinally and passing therethrough. The outer peripheral surface 212 of the plug body 21 protrudes to form a substantial rectangular guiding portion 214 opposite to the receiving fillister 213 which is perpendicular to the plug body 21 and extending longitudinally. Each of two opposite side surfaces 215 of the guiding portion 214 defines a pair of locking fillisters 216 spaced from each other and each extending substantially perpendicularly to the outer peripheral surface 212 of the plug body 21. The audio plug 22 has an inserting portion 221 at a front thereof and a first connecting portion 222 at a rear thereof. The plug body 21 and the audio plug 22 are fabricated as a single molded component, wherein the first connecting portion 222 is embedded in the plug body 21 and the inserting portion 221 is exposed out of a front surface 217 of the plug body 21.

Figure 6:
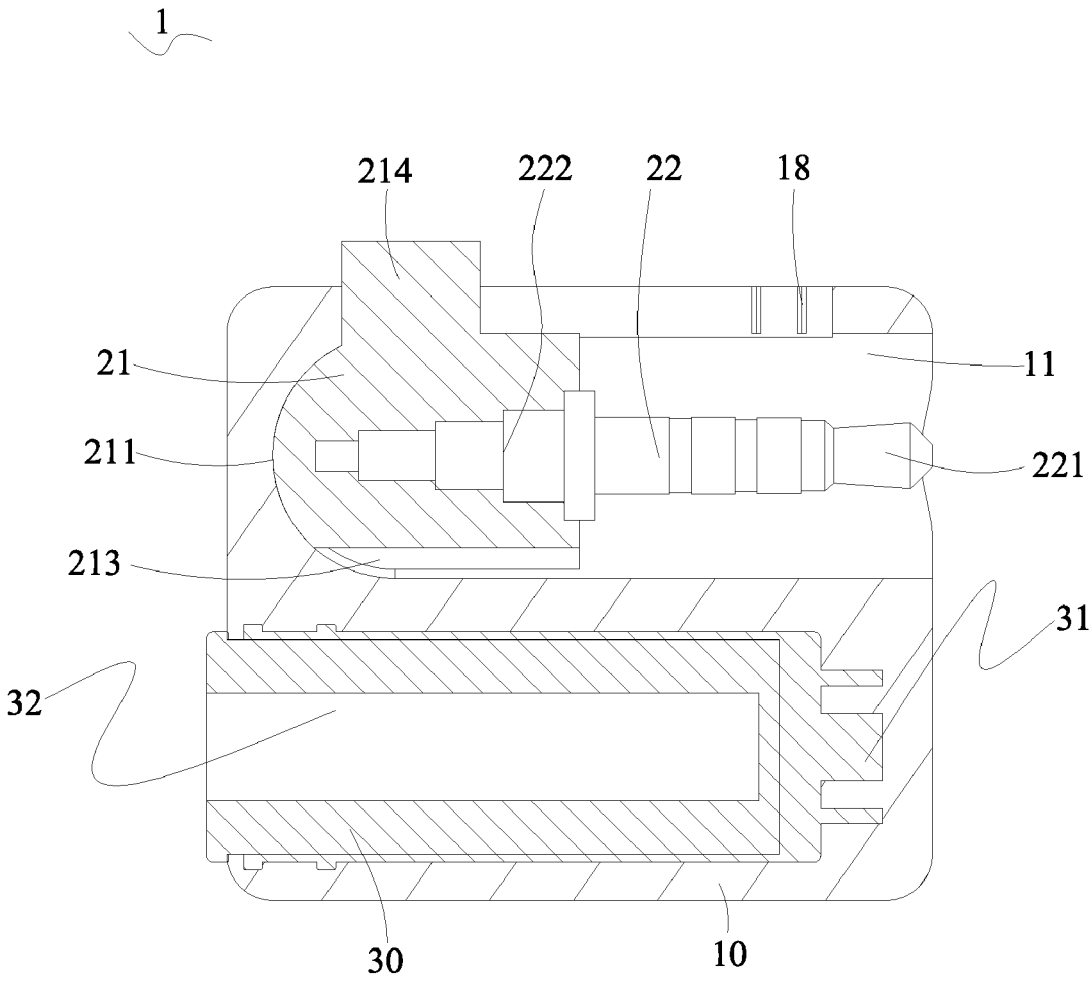
FIG. 6 is a cross-sectional view of the audio adapter of FIG. 1.
Figure 7:
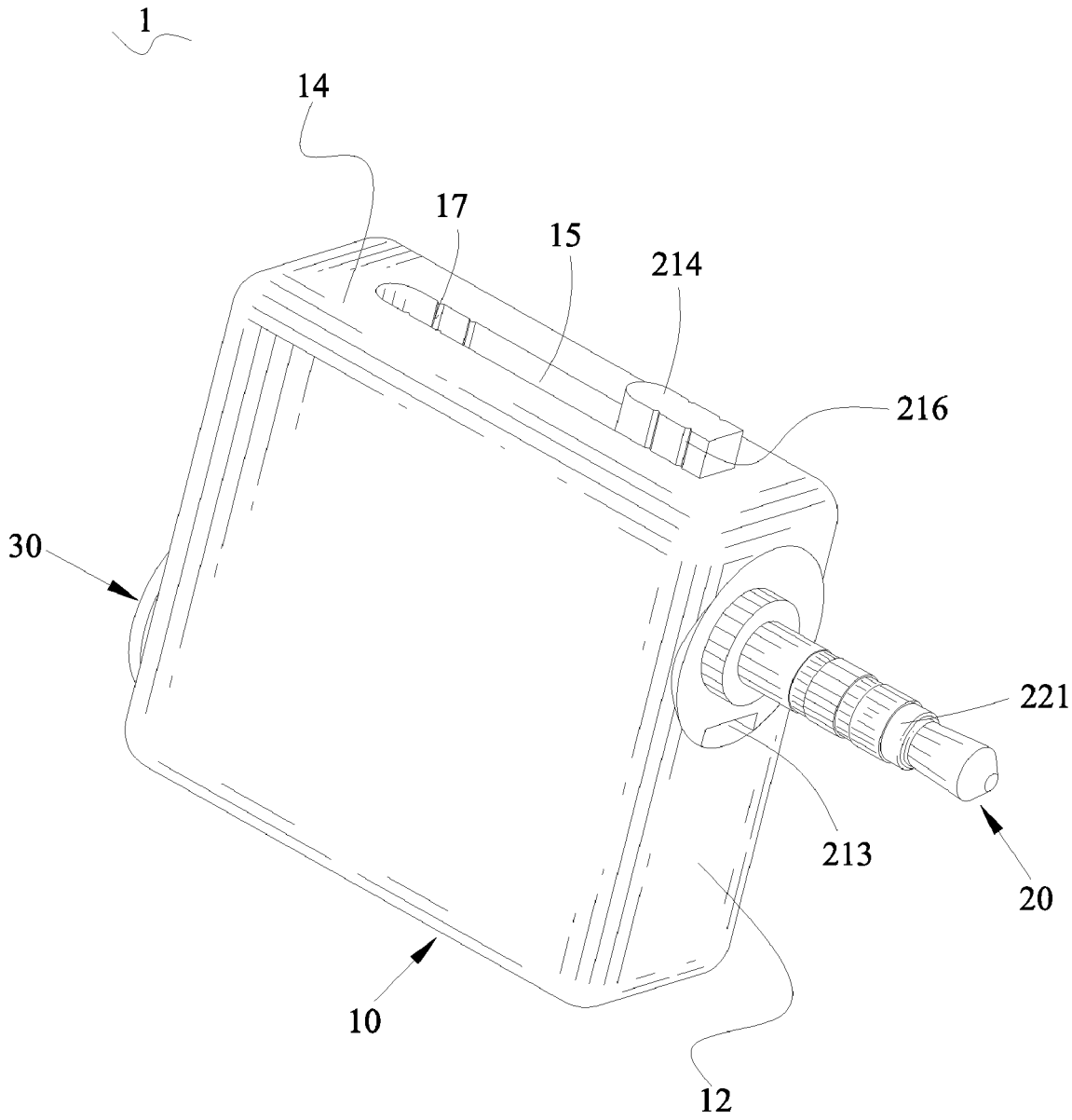
FIG. 7 is a perspective view of the audio adapter of the present invention, when the audio adapter is in use.

Referring to FIG. 2 and FIG. 6, the receptacle 30 is of substantially cylindrical shape and has a second connecting portion 31 at one end thereof. A middle of the receptacle 30 defines a cylindrical inserting hole 32 extending longitudinally to penetrate through an end surface thereof opposite to the second connecting portion 31 for receiving a corresponding external audio plug (not shown) therein.

Referring to FIGS. 1-7, the plug module 20 is integrated with the base body 10 when manufacturing the audio adapter 1 and is movable in the receiving cavity 11 of the base body 10. In this embodiment, the base body 10 is made of thermoplastic elastomer and the plug body 21 is made of polypropylene. The thermoplastic elastomer and the polypropylene are non-conglutinated, so the plug body 21 can still slide in the receiving cavity 11 of the base body 10 to drive the inserting portion 221 of the audio plug 22 projected out of or put into the receiving cavity 11 after plug module 20 is integrated with the base body 10. The mating surface 211 of the plug body 21 of the plug module 20 is mated with the concave surface 13 of the base body 10. The guiding portion 214 of the plug body 21 is slidably received in the guiding channel 15 of the base body 10 and exposed out of the base body 10. The first locking ribs 17 of the base body 10 are locked in the corresponding locking fillisters 216 of the plug body 21 to make the inserting portion 221 of the audio plug 22 put in the receiving cavity 11 firmly. The receptacle 30 is disposed in the holding chamber 19. The second connecting portion 31 of the receptacle 30 is electrically connected with the first connecting portion 222 of the audio plug 22 by means of a wire (not shown). The wire is long enough to have part received in the receiving fillister 213 of the plug body 21 for preventing the wire from breaking when the audio adapter 1 is in use.

When the audio adapter 1 is in use, the guiding portion 214 is pushed forward along the guiding channel 15 to drive the plug module 20 to slide along the receiving cavity 11 so as to make the inserting portion 221 of the audio plug 22 exposed out of the base body 10 to be mated with a corresponding external receptacle (not shown). At this moment, the second locking ribs 18 of the base body 10 are locked in the corresponding locking fillisters 216 of the plug body 21 to ensure a firm engagement between the base body 10 and the plug module 20 for preventing the inserting portion 221 of the audio plug 22 from being pushed back into the receiving cavity 11 of the base body 10 during the inserting portion 221 being mated with the external receptacle. When the audio adapter 1 is not in use, the guiding portion 214 is pushed rearward along the guiding channel 15 to drive the inserting portion 221 of the plug module 20 to be re-put into the receiving cavity 11 until the mating surface 211 is mated against the concave surface 13 again and the first locking ribs 17 are re-locked in the corresponding locking fillisters 216 to stop the plug body 20 from sliding out of the base body 10. So the inserting portion 221 of the audio plug 22 of the plug module 20 is well put in the receiving cavity 11 so that facilitates the audio adapter 1 to be kept and carried and further prevents the audio plug 22 from being damaged.

In this embodiment, the inserting hole 32 of the receptacle 30 has a diameter of 3.5 millimeters to be mated with the corresponding external audio plug therein, and the inserting portion 221 of the audio plug 22 has a substantial diameter of about 2.5 millimeters to be mated with the corresponding external receptacle so as to form an electrical connection between the external receptacle and the external audio plug even if the external receptacle is not matched with the external audio plug.

As described above, the audio adapter 1 of the present invention can make the audio plug 22 of the plug module 20 projected out of the base body 10 to be used by means of pushing the guiding portion 214 forward and put in the receiving cavity 11 of the base body 10 to be kept by means of pushing the guiding portion 214 rearward so that facilitates the audio adapter 1 to be kept and carried and further prevents the audio plug 22 from being damaged when the audio adapter 1 is not in use.

The forgoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. An audio adapter, comprising:

a base body defining a receiving cavity having one end opened freely at an upper portion thereof and a holding chamber at a lower portion thereof, a portion of the receiving cavity extending upward to penetrate through the base body to form a guiding channel extending along the same direction with the receiving cavity;

a receptacle held in the holding chamber; and a plug module, including a plug body movably received in the receiving cavity and provided with a guiding portion thereon, the guiding portion being slidably disposed and restrained in the guiding channel and partially exposed out of the guiding channel, and an audio plug having a connecting portion embedded in the plug body for being electrically connected with the receptacle and an inserting portion projected out of the plug body, wherein the guiding portion can be pushed along the guiding channel to drive the plug body to slide in the receiving cavity and further drive the inserting portion to be stowed into the receiving cavity.

2. The audio adapter as claimed in claim 1, wherein each of two opposite side surfaces of the guiding channel defines two pairs of locking ribs at two ends thereof respectively, each of two opposite side surfaces of the guiding portion defines a pair of locking fillisters capable of being buckled with the corresponding pair of locking ribs to ensure a firm engagement between the base body and the plug module.

3. The audio adapter as claimed in claim 2, wherein a concave surface is formed on an end wall of the receiving cavity, one end of the plug body opposite to the inserting portion of the audio plug is provided with a mating surface with respect to the concave surface.

4. The audio adapter as claimed in claim 1, wherein the base body and the plug body are made of two different materials which are non-conglutinated to make the plug body be slidable in the receiving cavity of the base body after the plug module is integrated with the base body.

5. The audio adapter as claimed in claim 4, wherein the base body is made of thermoplastic elastomer and the plug body is made of polypropylene.

* * * * *